US005558338A

United States Patent [19]

Taub

[11] Patent Number: 5,558,338

[45] Date of Patent: Sep. 24, 1996

[54] GAME ASSEMBLY FOR MULTIPLE SPORTS USAGE

[76] Inventor: Ronald H. Taub, 980 N. Michigan Ave., Chicago, Ill. 60611

[21] Appl. No.: 329,432

[22] Filed: Oct. 26, 1994

Related U.S. Application Data

[63] Continuation-in-part of Ser. No. 195,294, Feb. 14, 1994, abandoned.

[51] Int. Cl.[6] ..... A63B 67/00

[52] U.S. Cl. ..... 273/411; 273/55 B; 273/1.5 A

[58] Field of Search ..... 273/26 A, 411, 273/55 R, 176 B, 181 R, 182, 181 F, 181 K

[56] References Cited

U.S. PATENT DOCUMENTS

| | | | |
|---|---|---|---|
| 3,399,889 | 9/1968 | Harry | 273/1.5 R |
| 3,680,862 | 8/1972 | Russell | 273/55 R |
| 3,716,234 | 2/1973 | Lancelotte | 273/1.5 R |
| 3,820,787 | 6/1974 | Heinblgner | 273/55 B |
| 4,022,471 | 5/1977 | Keller | 273/411 |
| 4,083,561 | 4/1978 | Daffer | 273/411 |
| 4,145,044 | 3/1979 | Wilson | 273/1.5 R |
| 4,786,053 | 11/1988 | Barnes | 273/411 |
| 5,160,138 | 11/1992 | Sanders | 273/55 R |
| 5,193,802 | 3/1993 | Saltus | 273/55 B |

*Primary Examiner*—Theatrice Brown
*Attorney, Agent, or Firm*—Michael G. Berkman

[57] ABSTRACT

A versatile, multi-use base assembly constituting a stable support for post-like standards for each of series of different games to be played by children. In a football game and in a soccer game a base-carried supports an upwardly projecting wall. For the soccer game the wall defines a specially-contoured, tension-controlled resilient target area net for forcibly impinging a ball thereagainst, as occurs during the conduct of a game simulating soccer goal shots. The rebound trajectory is a function of the particular zone of the net impinged by the kicked ball, The football game simulates field goal attempts. Again, balls propelled to impact the tensioned, net-like target wall are automatically redirected toward the player for recoupment and for replay. In the basketball game of the invention the ball drops through the hoop to impinge upon an upwardly tilted top surface of the base or pedestal, The ball is, accordingly, redirected to the player.

9 Claims, 3 Drawing Sheets

GAME ASSEMBLY FOR MULTIPLE SPORTS USAGE

This is a continuation-in-part application of application Ser. No. 08/195294 filed Feb. 14, 1994 (Abnd).

FIELD AND BACKGROUND OF THE INVENTION

The present invention relates to a versatile, multi-use self-standing game assembly including a single base for use in a series of different selectable games including basketball, soccer and football games. In the football game a base-supported standard or post carries a frame and net. In the soccer game of the invention a pair of base-supported, laterally displaced posts in cooperation with upper rearwardly off-set rods define a net-carrying frame. In each of the football and the soccer games a net-like wall stretched across the frame demarks the bounds of a ball impact target zone. In a basketball game of the invention a standard supports a backboard and a net-carrying ring.

More particularly, the present invention is directed to a multi-use game assembly uniquely capable of providing an opportunity for children safely to amuse themselves while effectively developing and enhancing playing skills in several widely practiced popular sports.

Apparatus, devices and games for use in the practice of sports or related to sports, are known in the art. Such apparatus includes street hocky nets, golf practice devices such as back stop structures, football stops, kicking practice devices, ball catching nets and return devices, portable backstops for ball games, and pitching target apparatus. The devices so offered and promoted vary widely in complexity, in structural materials employed as well as in their efficacy.

Some of the prior art devices include apparatus for use by children. Typical are basketball game stands. For the most part, little has been done to provide games that will naturally aid in properly developing skills in young players.

A basket ball game assembly utilizing a standard and adapted for play in shooting baskets is described in Taub U.S. Pat. No. 5,163,676. The entire disclosure of that patent is hereby specifically incorporated herein by reference, to the extent it is not inconsistent herewith.

It is, accordingly, a principal aim of the present invention to provide a highly versatile game assembly embracing several different popular sports activities while utilizing a single base structure. The games of the invention are specially adapted to improve the sports skills of younger players.

SUMMARY OF THE INVENTION

The present invention is a self-standing game apparatus including a multi-functional base or pedestal which supports an upstanding frame or standard. In preferred embodiments of the invention a laterally extending wall secured to a frame and comprising a generally taut net or mesh has a specially contoured configuration. Target nets of the games of the invention also have controlled tension or degrees of resilience or elasticity. Each net defines an areal expanse constituting a target area to which a player aims or directs a ball kicked by the player as in kicking a goal in a soccer game. In the football game of the invention the player kicks a field goal or "extra point", the ball impinging against a stretched net carried on a base-supported standard.

An important feature of the present invention is that in the soccer game there is provided a framed wall of a unique configuration and which exhibits controlled tension. The wall is elastically resilient. A ball forcibly impinging upon the net-like wall or target zone when the ball is kicked for a goal as in soccer is redirected upwardly to rebound toward the player.

It is a feature of the present invention that the game assembly is light in weight, strong and stable, reliable and durable in construction, and that it will withstand the rigors of extended and challenging use in play.

In that version of the present invention finding utility as a soccer game assembly, the net-supporting frame includes a pair of base anchored laterally-spaced, generally parallel, upright legs surmounted by a horizontal cross arm or rod. A net material is firmly secured to the frame to define the target zone.

In one preferred embodiment of the invention involving the soccer game, the vertically extending framing members or legs are supported outwardly of the base or pedestal and the top cross arm is offset rearwardly.

It is an important feature of the soccer game of the invention that the net-carrying frame is so shaped as to establish for the supported net a configureation such that the path of ball rebound is a function of that area of the net impinged.

In versions of the present invention finding utility as structures defining an acceptable target area between laterally-spaced goal posts, as in a football set up, there is a single post-like standard projecting upwardly of the base or pedestal. The standard is surmounted by a centered horizontal bar at the ends of which uprights extend. A resilient, net-like screen is attached to embrace the areal target zone demarked by the horizontal bar and the pair of laterally spaced uprights.

It is a feature of the football version of the invention that a kicked or thrown ball impinging on the stretched target net is redirected to return toward the player.

In a preferred embodiment of the invention a Tee for supporting a football in an "at-ready" mode, is positioned in front of the post assembly as an aid in playing the game of the invention.

It is a feature of the invention that the lattice-like or net-like wall is fabricated of shock-absorbing woven threads or rope of resilient fibers such as nylon fibers or wound or woven filaments.

In one preferred embodiment of the invention the standards or frames of the game assemblies may conveniently be fabricated of rigid plastic tubing and connectors, thus minimizing costs.

A practical advantage of the standards and frames of the invention is that they are light in weight and exceedingly strong.

Preferred embodiments of the invention may be quickly and easily disassembled for transport and for storage. They may then be reassembled.

A feature of the assemblies of the invention is that the pedestal is formed with a top surface which is pitched or tipped to direct the ball toward the player, when the ball drops after striking the net, as in the football game or after passing downwardly through the basket net in the basketball game.

In a preferred embodiment of the invention directed to football, the uprights at each end of the standard-supported crossbar are formed at upper extremeties thereof with upwardly opening slots in which the target net is anchored and stabilized.

It is an important practical feature of the invention that it utilizes a single base or pedestal capable of supporting, selectively, the standards used in the football game and in the basketball game, and the frame used in the soccer game of the invention.

A related feature of the invention is that the base of the assembly includes upwardly opening sockets of different diameters to accommodate posts or standards different in size, and used in different games.

Yet another feature of preferred embodiments of the invention is that the walls defining the sockets of the base are formed with an array of annularly-spaced vertical ribs for engaging the cylindrical posts which seat in the sockets, facilitating assembly, and disassembly.

A feature of the base of the game assembly of the invention is that the base is formed with a hollow chamber or cavity which may be filled with a ballast material such as sand, gravel or water to stabilize the game assembly.

A feature Of the posts or standards of the invention is that they include simple mechanisms for adjustment of their heights, telescopially.

The base of pedestal of the game assembly of the invention is formed with a pitched, sloping or angled top surface so that a ball impinging on a net-like target or passing through the basketball ring drops down to hit the slanted base and is redirected toward the player.

Other and further features and advantages of the invention will be evident from the following detailed description considered in conjunction with the drawings.

DETAILED DESCRIPTION OF ILLUSTRATED EMBODIMENT

The aims and objects of the present invention are achieved by providing, for use with a series of separate and distinct portable games a versatile, multi-use base assembly constituting a stable support for post-like standards used in each of the different games to be played by children. Each game is designed and engineered to provide a realistic, practical, and safe method by which the players' skills in the several sports are improved.

In a first soccer game embodiment of the invention there is provided a pedestal-anchored and supported frame across which a vertically-extending, specially contoured, net-like backstop is secured. The backstop-carried net defines a resilient target area against which a kicked ball, such as a soccer ball, is forcibly directed to impinge in play. Controlled resilience of the tautly stretched net or backstop is effective to vault the ball upwardly and to redirect the ball toward a position from which it was forcibly propelled.

In a foothall embodiment of the invention there is provided an upright post or standard supported on the same base or pedestal used for the soccer game. An upwardly open U-shaped frame supported on the standard carries a net extending thereacross. A feature of the game assembly of the invention that a ball striking the net rebounds toward the player, or may drop to bounce upon a pitched or tilted top surface of the base or pedestal and then be redirected to the player.

In a basketball form of the invention, using the same base or pedestal as in the other games and using the same post or standard as in the football game, the post supports a backboard and a hoop or ring which carries a basket. Again, a ball dropping through the basket to impinge on the tilted top surface of the base is redirected to the player.

In preferred embodiments of the invention the frame is fabricated of conponents constituting-rigid plastics pipes or tubes and connecting fittings including L's and nipples, and T's. Typically the tubing may be about 1 5/16 inches OD and having a wall thickness of about 1/8 inch. Suitable tubing and the fittings are readily available, reducing greatly the cost of producing the frames of the invention.

Somewhat heavier tubing, for example tubing with an outer diameter of about 3 inches, and proportionally thicker, may be employed for the upright posts in the football frame and for the basketball game of the invention. In one embodiment of the invention, the lower section of the standard is surmounted by a reducing sleeve or coupling for accommodating an upper pipe section of a somewhat reduced diameter.

In a preferred embodiment of the invention, the vertical end poles of the football game frame are formed with upwardly opening slots at their upper ends to receive and secure the net which bounds the frame.

Figure 1:
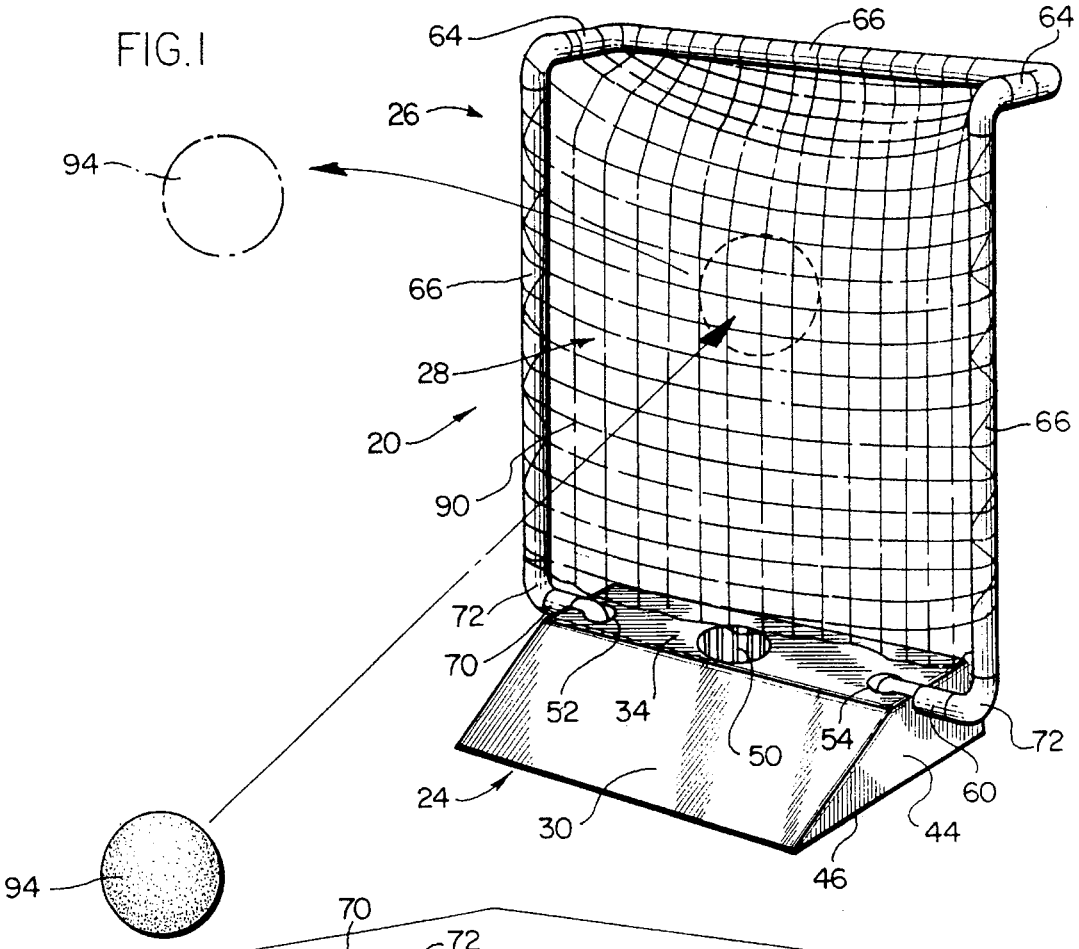
FIG. 1 is a front perspective view of one embodiment of the invention for use as a soccer "goal" and indicating schematically the vaulted return of a soccer ball after the ball impinges on the net of the goal structure.
Figure 2:
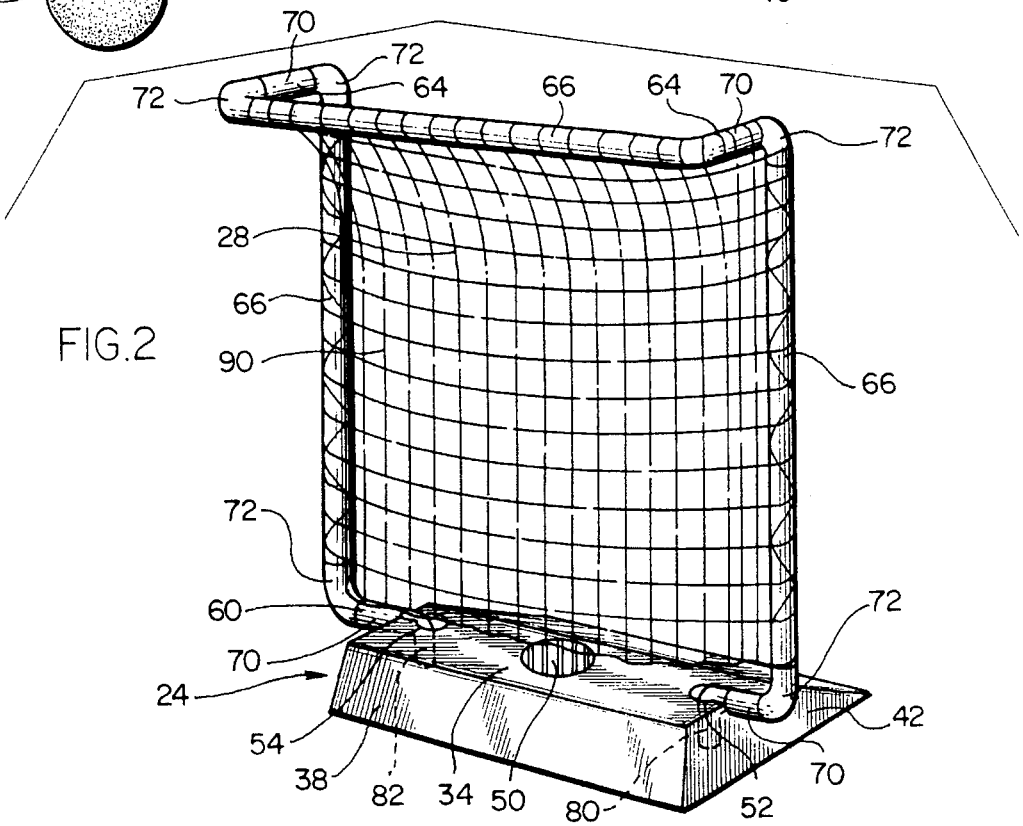
FIG. 2 is a perspective view of the same assembly shown in FIG. 1, but taken from the rear.

Referring now to the drawings, preferred embodiments of the game assemblies of the invention are shown for illustrative purposes, and are not to be construed in any limiting sense. That embodiment of the invention adapted for use as a soccer game is shown in FIGS. 1 and 2. The soccer goal target assembly 20 depicted includes the multi-use base or pedestal 24, of the invention, an upstanding tubular frame 26 seated in the base 24, and a target net 28 stretched on and secured to the frame 26.

The pedestal 24 which is preferably of a plastics composition, but which may be fabricated of wood or of a light weight metal alloy, is generally wedge-shaped in configuration. In the embodiment of the base 24 shown, there is an upwardly pitched or sloped front wall 30 terminating in a flat top wall 34 from which subtends a rear wall 38. A pair of side walls 42 and 44 and a floor 46 complete the pedestal 24 which defines a hollow chamber or cavity which may be filled with ballast to enhance the stability of the base 24. Opening upwardly of the top wall 34 of the pedestal 24 is an enlarged center socket 50 flanked by a pair of laterally displaced smaller end sockets 52 and 54.

The net-carrying frame 26 is generally in the shape of an inverted U, but in the particular embodiment of the invention illustrated is offset through arms 60 inwardly at its base and offset through arms 64 rearwardly at the top.

As shown, the frame 26 is fabricated of pipe or tubular sections 66, nipples 70 and L's 72.

In a preferred embodiment of the invention, the L's included ends 76 of reduced diameter for sleevedly seating within adjacent nipples 70 or pipe sections 66.

Stub pipes 80 and 82 projecting downwardly from lower arm sections of the frame 30 seat in cooperating holes or bores 52 and 54 formed in the pedestal 24. The latter 24 is slotted 84 to permit entry of the arms 60 at a height level with the top 34 of the base 24. The net 28 is over the area embraced by the frame 26 and is secured in place by interwoven strings or strands 90. Other means of attachment including clips, rivet or tie bands may be used.

As indicated schematically in FIG. 1, a soccer ball 94 kicked toward and impinging on the stretched net 28 will follow an upwardly vaulted course tending to return the ball 94 toward the player. Upon lower target impacts the pitched angle surface 38 of the pedestal 24, comes into play to redirect the ball to the player.

Figure 3:
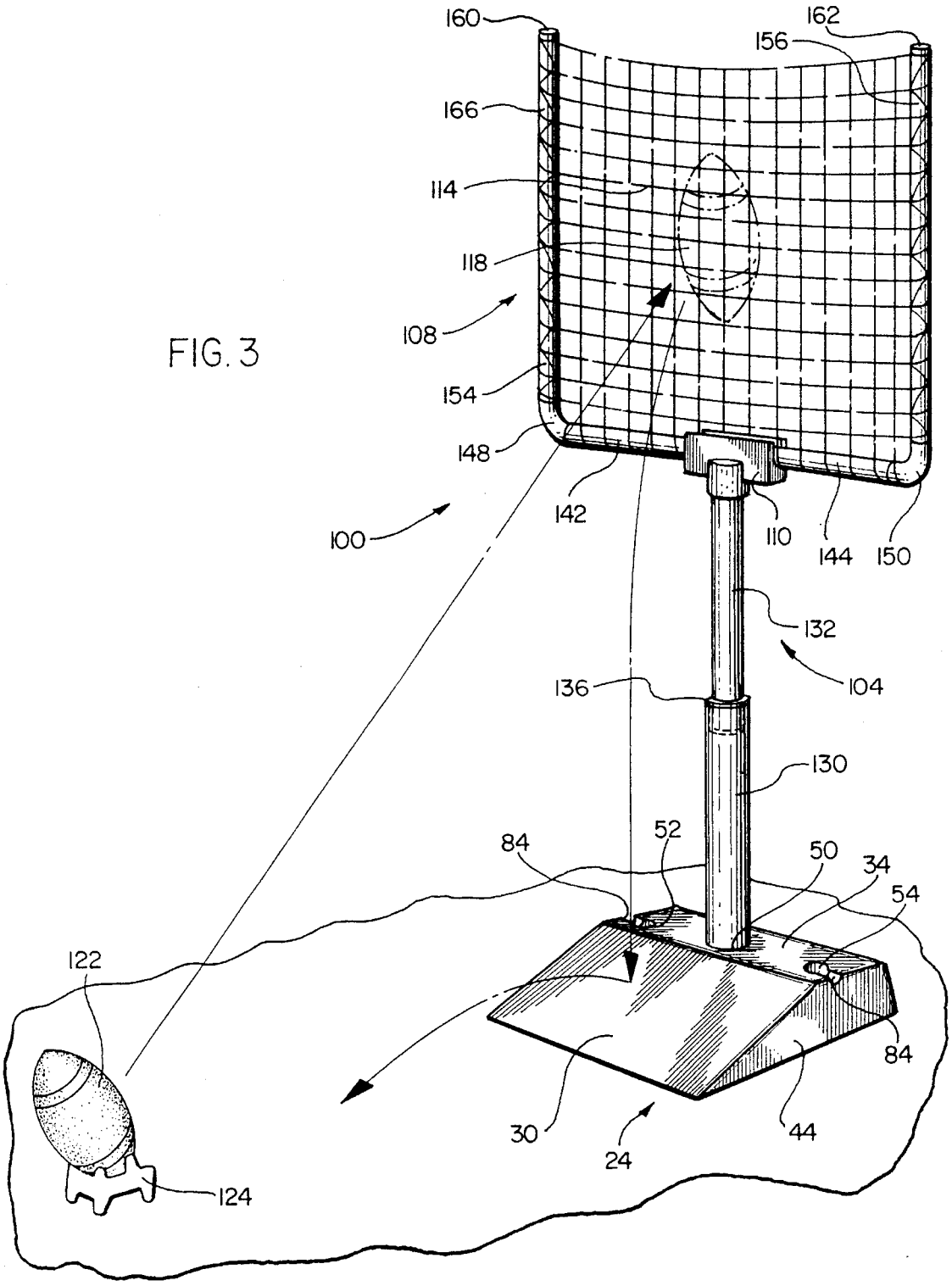
FIG. 3 is a front perspective view of a second embodiment of the invention, being a target for a football field goal or extra point and indicating schematically the return of the ball after it strikes the stretched target net.

A second embodiment of the invention, adapted for use as a football game assembly 100, is shown in FIG. 3. A vertically extending post or shaft 104 is surmounted by a U-shaped frame 108 by means of a T-shaped bracket 110, A net 114 is stretched and secured to the frame 108 which simulates goal posts. The frame 108 defines a target zone 119 toward which a player, kicking a football 122 supported on a T 124, may direct his efforts.

The structure of the post 104, though not critical, is shown in a preferred embodiment as including a heavy base pipe 130 seated in the large socket 50 formed in the base or pedestal 24. Sleeved in and extending upwardly of the base pipe 130 is an extension pipe 132 of a somewhat smaller diameter, the two being coupled by a compression collar 136 to provide for height adjustment of the frame 108. The upper pipe 132 is capped by the T-shaped bracket 110 which supports the frame 108. A pair of horizintal arms in the form of pipe sectors 142 and 144 of a plastics composition joined to the T bracket 110 are connected at their ends to L's 148 and 150. L-like pipe sections 154 and 156 connected and projecting upwardly from the L's 148 and 150 complete the net-carrying standard 100. Upwardly opening slots 160 and 162 are formed at the upper extremities of the legs 154 and 156 to receive strands of the net 114 therethrough to stabilize the net.

As indicated schematically, a football 122 kicked to impinge on the net 114 will drop and hit the pitched face 30 of the pedestal 24 and will be redirected toward the player. It will be understood that overall height of the standard may conveniently be varied utilizing the telescoping feature of the intersleeved pipe components 130 and 132. The mesh or net 114 may be fastened to the framing members 142, 144, 154 and 156 using any preferred means including securement strands or cording 166.

Figure 4:
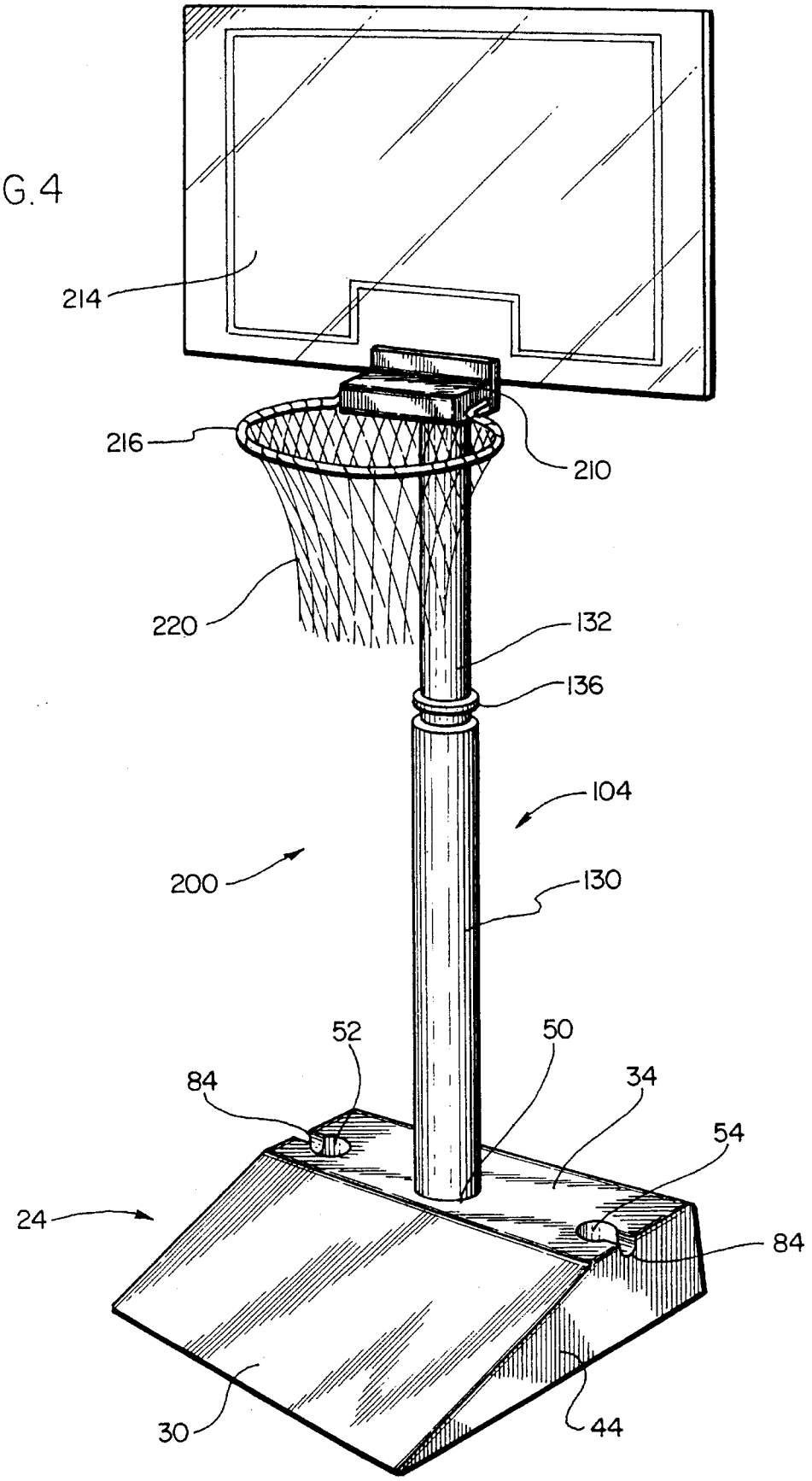
FIG. 4 is a front perspective view of a basketball assembly according to the invention and using the same base of pedestal as in the other illustrated games of the invention.

Referring now to FIG. 4, there is shown a basketball game assembly 200, according to the present invention. The assembly uses the same base 24 as in the soccer game assembly 20 and in the football game assembly 100. Additionally the basketball game depicted utilizes the same two-piece standard or post 104, including a larger lower component 130 seated in the large cemter socket 50 of the pedestal 24.

As in the case of the football game, a somewhat smaller upper post 132 of the standard 104 is sleeved in the lower section 130, telescopically, for convenient height adjustment. A bracket 210 surmounting the upper post 132 supports a backboard 214 and a ring or hoop 216 from which a net 220 is suspended.

It is a significant and unique, feature of the invention that the net, for example in the soccer game, is so supported and tensioned as effectively to prevent invasion or signifigant penetration by the ball which forcibly impinges against or strikes the net. Entrapment is obviated. Return of the ball toward the player is enhanced. In according with the practice of the present invention, the same phenomenon is invoked in the tautly mounted net of the football game.

The principles taught herein apply as well in order, different games where the ball or other article, for example the puck in a hockey game, is driven against and strikes, the goal net.

What is claimed is:

1. A game assembly for use in playing different and distinct ball games comprising multi-functional base means for accommodating a plurality of standards adapted for use, selectively, in a plurality of different ball games, said base means including a stable pedestal having a plurality of horizontally spaced, vertically extending sockets for matingly receiving therewithin posts for supporting structures including nets, support post means for seating in said sockets and for supporting a net means net means defining target zones toward which balls associated with each of said plurality of games may be impelled, said games including basketball, football, and soccer games.

2. An assembly as set forth in claim 1 wherein said base means is formed with an interior chamber for accommodating storable weighing material therein for stabilizing said game assembly during play.

3. An assembly as set forth in claim 1 wherein said sockets in said base means include centrally-disposed socket for accommodating a tubular, upstanding standard for supporting alternately any one of a basketball game backboard having a ring-carried net attached thereto, and a standard for supporting a goal post structure for a football game.

4. An assembly as set forth in claim 1 wherein said sockets include a pair of laterally-spaced sockets adjacent lateral limits of said base means, frame means for supporting said net means extending generally upwardly of said base means, said frame means including post means displaced laterally of and beyond said base means at either side thereof for delineating lateral limits of a target zone of said game assembly, horizontally-extending, rearwardly-displaced upper rod means bridging said post means and for defining an upper framing element of said frame means, and said net means being connected to said post means and to said upper rod means for defining an areal target zone for a ball impelled thereagainst, to impinge thereon and to rebound therefrom.

5. An assembly as set forth in claim 4 in which said horizontally-extending, rearwardly-displaced upper rod means of said frame means in cooperation with said post means defines a net support having a configurational attitude effective to cause an impelled ball impinging upon an upper areal zone of said net means to be directed arcuately upwardly as it rebounds from said net means, to direct the ball to traverse a return path in the air rather than along the ground.

6. A game assembly as set forth in claim 1 further comprising a U-shaped frame supported on said attached to said post means at an upper end thereof, and said net means being fastened to said frame to define a target zone for a football directed toward said net.

7. A game assembly as set for in claim (1) 1 wherein said post means comprises a standard having upper and lower ends, said lower end being seated in one of said sockets; a backboard and a basket ball ring having a net thereon; adapter means for securing said backboard and said ring at said upper end of said standard for basketball play.

8. An assembly as set forth in claim 7 further comprising means for adjusting the effective height of said standard.

9. An assembly as set forth in claim 1 wherein said post means defines a tubular structure adapted for filling with a particulate weighing aggregate.

* * * * *